US008313389B2

(12) United States Patent
Crawford et al.

(10) Patent No.: US 8,313,389 B2
(45) Date of Patent: Nov. 20, 2012

(54) RING CAROUSEL RIDE

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 305 days.

(21) Appl. No.: 12/871,030

(22) Filed: Aug. 30, 2010

(65) Prior Publication Data

US 2012/0052961 A1 Mar. 1, 2012

(51) Int. Cl.
*A63G 1/06* (2006.01)
*A63G 21/00* (2006.01)

(52) U.S. Cl. ..... 472/41; 472/90; 446/325

(58) Field of Classification Search ..... 472/1, 27–29, 472/35, 36, 40, 41, 89, 90; 446/325, 326, 446/367

See application file for complete search history.

(56) References Cited

U.S. PATENT DOCUMENTS

| | | | | |
|---|---|---|---|---|
| 516,616 | A * | 3/1894 | Somers | 472/41 |
| 553,468 | A * | 1/1896 | Hughes | 472/41 |
| 583,109 | A | 5/1897 | Daniels | |
| 797,347 | A * | 8/1905 | Degenhardt | 472/41 |
| 925,402 | A * | 6/1909 | Vangezell | 472/40 |
| 1,109,421 | A * | 9/1914 | Jobson | 472/41 |
| 1,399,582 | A | 12/1921 | Sayih | |
| 1,499,672 | A | 7/1924 | Lezert | |
| 5,810,641 | A * | 9/1998 | Lo | 446/325 |
| 6,477,961 | B1 | 11/2002 | Mares | |
| 6,939,236 | B2 * | 9/2005 | McLaren et al. | 472/90 |

FOREIGN PATENT DOCUMENTS

| | | | |
|---|---|---|---|
| DE | 351934 | C | 4/1922 |
| FR | 330134 | A | 8/1903 |
| FR | 446496 | A | 12/1912 |
| JP | 2193690 | A | 7/1990 |

OTHER PUBLICATIONS

Fantasy World Entertainment, Derby Racer, http://www.fwworld.com/competitive%2Ohs.htm; retrieved Aug. 30, 2010.

Extended European search report for EP11178715, dated Dec. 1, 2011, from European Patent Office, Munich.

* cited by examiner

*Primary Examiner* — Kien Nguyen

(74) *Attorney, Agent, or Firm* — Marsh Fischmann & Breyfogle LLP; Kent A. Lembke

(57) ABSTRACT

A carousel ride in which vehicles may move at differing speeds, in differing directions, and each be independently positioned relative to a load/unload platform. In one embodiment, a carousel ride is provided that includes: (1) an inner ring assembly including a first ring supporting vehicles and a drive system operable to rotate the first ring about a center axis of the carousel ride; and (2) an outer ring assembly including a second ring, concentric to the first ring, supporting vehicles and a drive system operable to rotate the second ring about a center axis of the carousel ride. During a portion of a ride; the drive system of the inner ring assembly operates to rotate the first ring at a first rotation rate, and the drive system of the outer ring assembly operates to rotate the second ring at a second rotation rate differing from the first rotation rate.

17 Claims, 10 Drawing Sheets

RING CAROUSEL RIDE

BACKGROUND

1. Field of the Description

The present description relates, in general, to amusement and theme park rides, and, more particularly, to a carousel ride system with independently driven, concentric rings that each support passenger vehicles/rider conveyance devices and/or support ride elements (such as line of sight or line of fire obstacles/shields, set or environmental pieces enhancing the ride experience, game elements such as targets or the like, and so on).

2. Relevant Background

Amusement and theme parks are popular worldwide with hundreds of millions of people visiting the parks each year. Park operators continuously seek new designs for rides that attract and continue to entertain guests. Many rides have been utilized for many years with the only changes being cosmetic such as changing theme elements (e.g., to have images and vehicles from a popular movie, television show, or video game) or vehicle designs. Such cosmetic changes do not change the ride experience to any degree as the vehicle moves in the same way, at the same speeds (or ranges of speeds), and over the same predictable path.

For example, the traditional carousel ride is over one hundred years old and is still provided in nearly every amusement park. A carousel or merry-go-round is an amusement park ride that includes a rotating circular platform, which is also used as the loading platform. On the circular platform, numerous vehicles or rider conveyance devices (or just "seats") are provided and are supported on posts or poles. For example, a conventional carousel may provide rows of wooden horses or other animals mounted on posts. A central rotating hub is used to rotate the circular platform often to looped circus or other music. When the platform is rotated about the central hub (or a rotation axis passing there through), all or many of the horses or other vehicles are moved up and down via gear work or other mechanical devices connected to the mounting post/poles to simulate galloping or other movement of the vehicles.

While still popular, most carousel rides do not provide any interactivity and become very predictable. The ride is generally operated at a single rotation speed and the vehicles (via the supports/posts) are moved up and down in a fixed pattern. This results in a relatively generic experience with a common (among all carousels), repeating dynamic profile. Riders most often will only ride a carousel once due to this predictability and lack of excitement. Park operators and ride designers continue to search for a way to create a new carousel ride that provides a more exciting and variable ride experience, such as with less predictable vehicle movements, enhanced storytelling opportunities, and/or rider interactivity, so as to encourage new riders to try the new carousel ride and to increase repeat ridership.

Another issue with many carousel rides is difficulty with loading and unloading. Typically, the movement of the vehicles up and down is provided mechanically in a fixed or rigid manner such that at the end of each ride many of the vehicles (such as a horse) are not positioned in an ideal load/unload position. In fact, about one third of the vehicles will likely be at their highest position above the circular platform. Many riders, including the very young and elderly, may have difficulty getting into or onto such a vehicle during loading at the start of a ride and may also have difficulty getting out of or down off of the vehicle during unloading at the end of the ride. Hence, park operators and ride designers are also faced with the challenge of enhancing the load/unload operation of a carousel ride.

SUMMARY

The present invention addresses the above problems by providing a new type of ride for use in amusement and theme parks that retains the desirable features and the footprint of existing carousels while providing a more varied and interactively appealing ride. The new ride described may be labeled a ring carousel ride because the ride includes two or more ring-shaped vehicle support surfaces that are concentric and that are independently driven. For example, each support surface may be an upper, planar surface of a ring or ring-shaped body, and each ring may be paired with a circular track by guides (that support the ring and also keep the ring aligned with the track). Then, one or more drive systems (e.g., a motor and a traction wheel) may be attached to the ring and abut (with a drive element such as the traction wheel) a surface of the track such that when the drive systems are operated the ring is moved about a center or rotation axis of the ride at one or more rotation rates (e.g., a range of RPMs defined by a motion or ride profile provided by a controller).

The rings may be driven independently in the same or different directions and at the same or differing speeds. In this manner, the supported vehicles may move in opposite directions or in the same directions but at differing speeds throughout a ride experience provided by the new ring carousel ride. Further, each vehicle may be individually positioned (e.g., at a height relative to a load/unload surface of the associated ring) to further enhance the ride experience (e.g., since not tied to a motion profile repeated each rotation can move through a motion profile that extends beyond one rotation of the ring about the center axis) and improve operational efficiency (e.g., return all vehicles to load/unload position at end of ride).

More particularly, a carousel ride is provided that includes: (1) an inner ring assembly including a first ring supporting a number of rider conveyance elements and a drive system operable to rotate the first ring about a center axis of the carousel ride; and (2) an outer ring assembly including a second ring, concentric to the first ring, supporting a number of rider conveyance elements and a drive system operable to rotate the second ring about a center axis of the carousel ride.

In some embodiments during a portion of a ride operation of the carousel ride (e.g. for at least a portion of a ride), the drive system of the inner ring assembly operates to rotate the first ring at a first rotation rate, and the drive system of the outer ring assembly operates to rotate the second ring at a second rotation rate differing from the first rotation rate. This may be used, for example, to provide a racing experience or to change interaction between riders as differing rider conveyance elements (e.g., a carousel horse or the like) are adjacent to each other during the ride. In some cases during a portion of a ride operation of the carousel ride, the drive system of the inner ring assembly operates to rotate the first ring in a clockwise direction about the center axis and the drive system of the outer ring assembly operates to rotate the second ring in a counterclockwise direction.

According to another aspect, the inner ring assembly may include a first ring-shaped track adjacent the first ring and a plurality of guide assemblies retaining the drive system of the inner ring assembly in contact with the first ring-shaped track. Likewise, the outer ring assembly may further include a second ring-shaped track adjacent the second ring and a plurality of guide assemblies retaining the drive system of the outer ring assembly in contact with the ring-shaped track. Also, the first ring may include a planar top surface with the rider conveyance elements being supported above the top surface of the first ring. Similarly, the second ring may include a planar top surface with the rider conveyance elements being supported above the top surface of the second ring. In such cases, the top surfaces of the first and second rings may be substantially coplanar or be offset from each other (e.g., tiered).

In some embodiments of the carousel ride, the inner ring assembly may further include a vehicle positioning mechanism associated with each of the rider conveyance elements. In this way, each of the vehicle positioning mechanisms may be configured to be independently operable so as to move the associated rider conveyance element through a range of heights according to a motion profile, which may differ among the conveyance elements (e.g., provide a milder experience for some rings of a carousel ride and more thrill motion in others or allow guests to select the experience level individually or even directly control the motion of their vehicle). The motion profile is used to define the range of heights (such as control signals provided by a ride control system executing a ride program), and this motion profile may extend over more than one full rotation of the inner ring about the center axis. In some embodiments, the vehicle positioning mechanisms operate concurrently at an end of a ride operation of the carousel ride to position all of the rider conveyance elements in a load/unload position (such as their lowest elevation) to enhance the load/unload operation and ease of use by all riders.

DETAILED DESCRIPTION

Figure 1:
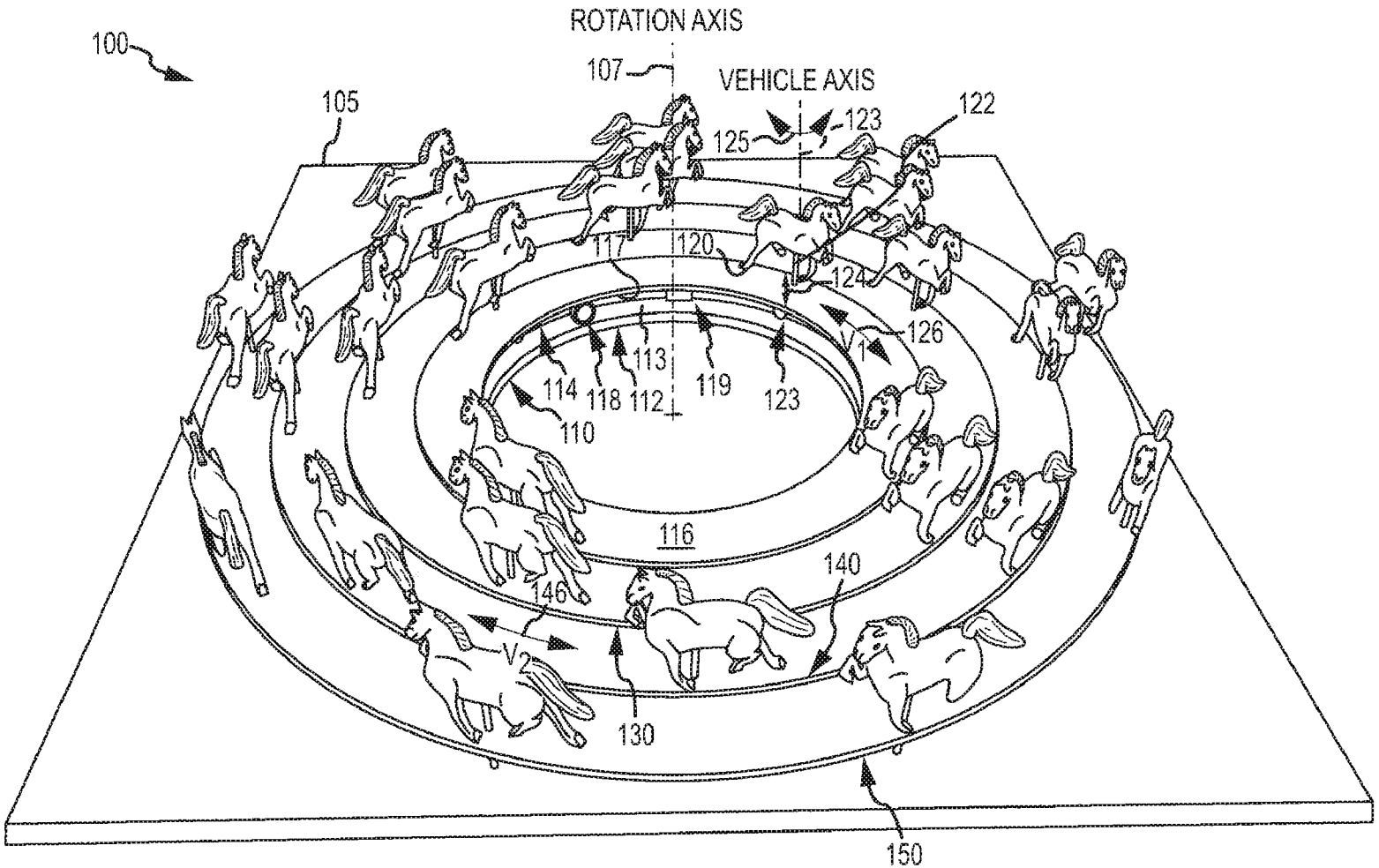
FIG. 1 is a top perspective view of a ring carousel ride (or, more simply, a carousel ride) with four concentric and independently supported and driven rings or ring-shaped platforms each supporting a set of passenger vehicles (shown, in this example, as horses)

The description is generally directed to a new carousel-type ride that provides enhanced passenger or rider interactivity and varied experiences. The ride or ride system may be thought of as a ring carousel ride or a carousel with two or more, independently driven, concentric rings/ring platforms each with a number of individually actuable/positionable vehicles (or rider/passenger conveyance elements). This is in contrast to a traditional carousel ride in which there is a single load/unload platform that is rotated about a central hub and, in which, the vehicles or horses are not individually positionable/controllable but are positioned with a fixed cam arrangement to move up and down.

In some embodiments, each ring can be driven at different speeds (or rates of rotation about a central or rotation axis) and/or in opposite directions to create a unique ride experience. For example, the independently driven rings may be used to provide a realistic racing experience that includes passing and head-to-head racing (and, in some cases, near misses). Further, the ring carousel ride may be used to provide novel gaming and interactive experiences such as by use of the relative motion between rings allowing proximate vehicles to be moved or changed (e.g., in contrast to traditional carousels, the vehicles on your left and right may be changing on a continuous or selective basis throughout the ride).

Prior to describing specific embodiments, it may be useful to provide an overview of embodiments of the concentric-rings carousel ride concept(s). Each ring is arranged to be independent (e.g., to be able to move separately from adjacent/other rings of the ride), and each ring is constrained to, and runs on, a fixed track structure. The rotation of each ring is independently driven by a drive assembly such as by an electric propulsion system that may include one or more pacer, pinch, and/or magnetic drives. Also, each ring is constrained on its track by a guide assembly. In some embodiments, the guide assembly is a caster arrangement with load and side guide wheels that support the normal load of the ring and also keep the ring aligned with the fixed track structure positioned below the ring (and vehicles supported on the rotating/rotatable ring). Each ring can be driven continuously or selectively (or even stopped during a ride while other rings continue to move such as for an obstacle/game element ring) in either direction (e.g., clockwise (CW) or counterclockwise (CCW) about the central/rotation axis of the ride).

A set of vehicles or passenger conveyance elements/devices are mounted or supported on each ring or ring platform. In some embodiments, motion of individual rider conveyance elements relative to the rotating ring is incorporated into the design of the ride, and such motion may include heave, yaw, rotation, and up/down movements of the vehicles. Motion of the individual vehicles may be realized with a vehicle positioning mechanism or actuator provided for each vehicle that may be separately controlled/operated to change the position of the vehicle (in an independent or synchronized (controlled by a ride controller and ride programming/software programs)) as the ring it is attached to rotates about the center axis of the ride. For example, but not as a limitation, each vehicle may be associated with an electric motor/drive system. In such electric motor/drive implementations, power and control signals may be transferred to the individual rings through track mounted bus bars, slip rings, or the like. Drive units may also be mounted onto the fixed track structure with hardwired connections. Some embodiments, in contrast, may utilize a conventional mechanical cam system to control up/down (other) movements of the vehicles of a ring, but the use of multiple rings can allow differing movements of vehicles in each ring (e.g., a tame/mild ride on one ring, an intermediate/less mild ride on a second ring, and a wild/thrill ride on a third ring) of the ride to provide differing experiences within a single carousel ride.

In some preferred embodiments, the motion of the rider conveyance elements or vehicles is through the use of electric motors/drive systems. Such systems, provided in a way that each vehicle may be separately positioned relative to the rotating ring, make possible significant improvements over a traditional carousel experience. As a first example, the drive systems may be programmed (such as via an onboard or offboard ride control system (or ride programs run by such a control system or its hardware processors (e.g., executing programs or computer code devices in computer readable medium/memory))) to stop all the vehicles at their lowest positions to facilitate loading and unloading so as to address operational issues with traditional carousels where a horse/vehicle may stop at a high position. Secondly, the ride profiles (e.g., defining movement of vehicles) may be programmed/designed to create non-repeating sequences that are longer than a single rotation of the ride (or turntable). For example, the motion of a vehicle could get progressively more intense as the ride progresses, with or without movements/motion being repeated from one rotation to the next (in contrast to a traditional carousel in which the vehicle movement is fixed and is repeated each and every rotation of the platform). As a third example, custom ride profiles may be selected by the passengers/riders such as to suit their ability or ride preferences (e.g., mild, wilder, extreme, or the like) such as by making a selection when entering/mounting a vehicle or by selecting a carousel ring dedicated to a type of ride experience (e.g., the mild outer ring or the extreme inner ring or the like). As a fourth example, each rider may be provided direct rider control over the vehicle drive/positioning system via a user input device associated with each vehicle.

Figure 2:
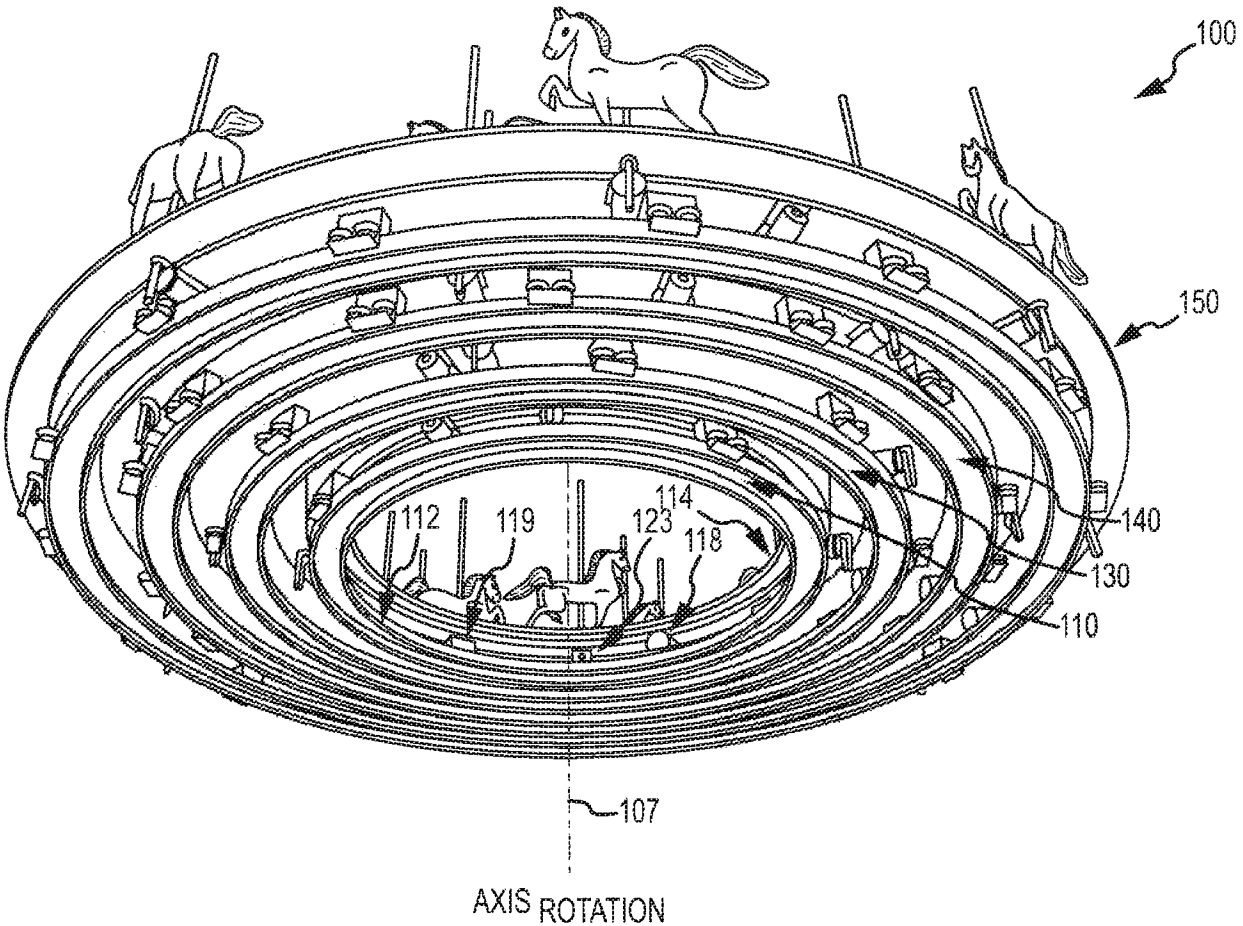
FIG. 2 is a bottom perspective view of the carousel ride of FIG. 1 with the base or platform removed to expose the underside of each of the four track assemblies including the bottom of each circular track and components for driving and guiding the ring-shaped platforms or rings.

FIGS. 1 and 2 illustrate (with top and bottom perspective views) a ring carousel ride 100 according to one embodiment that provides vehicles mounted to or supported on four ring-shaped, independently driven, vehicle support surfaces. As will become clear from the following description, the ring-shaped surfaces (and corresponding vehicles) may be rotated in the same or differing directions about a central or rotation axis 107 of the ride 100 (e.g., in a CW or CCW direction about axis 107). The surfaces of ride 100 are shown to have the same width but differing widths may be utilized such as narrower rings for providing obstacles or other game elements or providing set or other environmental elements that enhance the ride experience (e.g., to suit a ride's theme or the like).

FIG. 1 shows that the ride 100 may include a platform or base 105 upon which two or more ring assemblies may be positioned or supported so as to provide two or more rotating ring-shaped surfaces. As shown, the ride 100 includes four ring assemblies 110, 130, 140, 150 that are used to provide first, second, third, and fourth rotating ring surfaces (or inner and outer rings with two intermediary rings, in this case). For ease of explanation, the components of inner or first ring assembly 110 are discussed in detail with it being understood that ring assemblies 130, 140, 150 would include similar components and have similar operations. During operation, each of the ring assemblies 110, 130, 140, 150 may be operated independently or in concert to provide a unique carousel-based ride experience. This is shown with arrow 126 on the first ring assembly 110 and the arrow 146 on the third ring assembly that illustrate that each ring surface may be moving in one or two directions (CW or CCW) about the axis of rotation 107 of the ride and at the same or differing speeds ($V_1$ may equal $V_2$ or differ from $V_2$). This is achieved by providing separate supports for the ring surfaces (or rings with top or load/unload surfaces) and separate ring drive systems for each ring surface (or each ring).

To these ends, ring assembly 110 is shown in FIG. 1 to include a track or track structure 112 and a ring body or, simply, a ring 114. The ring 114 is supported on an upper surface 113 of the track 112, and both the ring 114 and track surface 113 are circular in shape or are ring shaped (e.g., a circular with a particular width). The ring 114 is supported upon the track surface 113 by a number of ring drive systems 118 (e.g., two, three, or more such ring drive systems) that are typically rigidly attached to a lower surface 117 of the ring 114 and roll upon (or rollably engage) the track surface 113. To maintain the ring 114 upon the track 112, the ring assembly 110 also includes a number (e.g., two, three, or more) of guide assemblies 119. These assemblies 119 also are generally rigidly attached to the lower surface 117 of the ring 114 and roll upon a portion(s) of the track 112. But, as with the drive assemblies 118, the guide assemblies 119 may be fixed to the track 112 and rollably (or slidingly) engage the ring 114. Typically, the ring drive assemblies 118 and ring guide assemblies 119 will be equidistally spaced about the track 112 and ring 114, but this arrangement is not a requirement.

During operation of the ride 100, the drive assemblies 118 will generally be concurrently operated, such as in response to control signals from an offboard ride controller, to roll upon the surface 113 in a CW or CCW direction and at a particular rotation rate. In other words, each of the drives 118 is operated similarly to move the ring 114 about the rotation axis 107. The ring 114 includes an upper or load/unload surface 116 and operation of the drives 118 causes the surface 116 to rotate as shown with arrow 126 about axis 107 at a particular velocity, $V_1$. As noted above, this may be the same or differ from other ring velocities, such as the velocity, $V_2$, of the surface of ring assembly 140 so as to achieve desired ride experiences (e.g., a racing effect, a gaming experience, differing thrill levels in each ring 110, 130, 140, 150, and so on). In this manner, each of the ring assemblies 110, 130, 140, 150 may be operated independently of the movements/operations of other ring assemblies 110, 130, 140, 150. In portions of a ride, though, the rings 110, 130, 140, 150 may be driven separately but to a similar effect. For example, it may be desirable to start a ride 100 with all rings 110, 130, 140, 150 moving a single direction and a similar speed and then change the speed(s) of one or more of the rings to achieve a desired effect.

Each ring assembly 110, 130, 140, 150 also includes a number of passenger vehicles or rider conveyance elements (e.g., carousel horses or the like), and these vehicles are mounted on or supported by the rings of each assembly 110, 130, 140, 150 so as to rotate about the axis 107 with the rings (e.g., in the same direction and same velocity or RPMs as the ring-shaped surface). This can be seen with inner ring assembly 110. The ring assembly 110 includes a plurality of vehicles 120 that are supported above the top surface 116 of the ring 114 by a post or pole 122. In some embodiments, the vehicles 120 (or a portion thereof) may be stationary, but, in many embodiments, the post 122 is further linked to a vehicle positioning mechanism/assembly 123. The vehicle positioning mechanism 123 is configured to operate to position the vehicle 120 relative to the ring surface 116 such as by moving the vehicle up and down as shown with arrow 124 to change the height of the vehicle 120 (e.g., from a lowest or lower load/unload position to one or more higher positions such to move the vehicle 120 through a motion profile defined for a particular ride or operating design for ride 100).

The vehicle 120 may be rigidly affixed to the post/pole 122 or be attached for rotation 125 about the pole's axis 123. The rotation or other movement of the vehicle 120 about or relative to the pole 122 may be performed by operation of the vehicle positioning assembly 123 to rotate the pole 122 and attached vehicle 120. In other cases, the vehicle 120 may be moved 125 by the riders/passengers of the vehicle 120 operating an input device associated with the vehicle 120. Likewise, the operation of the vehicle positioning assembly 123 may be in response to a ride controller (not shown in FIG. 1) providing control signals or may be in response to a rider operating a vehicle-based user input device (e.g., allow the rider to control/change 124 the height of the vehicle 120 and/or to control the angular orientation 125 of the vehicle 120 relative to the vehicle axis 123).

In this manner, each of the vehicles 120 of each ring assembly 110, 130, 140, 150 may be individually and/or independently positioned vertically 124 and angularly 125 relative to a rotation axis 123. This is a significant improvement over prior carousels as it allows the vehicles 120 to all be positioned 124 in a load/unload position at the beginning/end of a ride and also allows for unique ride experiences as the vehicles may be moved in unpredictable manners such as based on a motion profile that may last more than one rotation of the ring surface about axis 107 or differently for each ring (or within a ring).

FIG. 2 illustrates the ride 100 from a bottom perspective. In the illustration, the base or platform 105 has been removed to show the track structures of the four ring assemblies 110, 130, 140, 150. It can be seen that the track structure 112 of the inner ring 110 is separate from the other tracks and defines a circular path of a first diameter about the rotation axis 107. Then, moving from inner assembly 110 to outer ring assembly 150, each track structure defines a different and separate circular path with second, third, and fourth diameters (each increasing in size) about the rotation axis 107. FIG. 2 is also useful for illustrating that each ring assembly 110, 130, 140, 150 uses a plurality of ring guides, ring drives, and vehicle positioning mechanisms (such as those shown at 118, 119, and 123, respectively, for ring assembly 110) to achieve the independent driving/motion of the rings in the ride 100 as well as the individual actuation of each vehicle (such as vehicle 120 with vehicle positioning mechanism 123).

As can be seen from studying FIGS. 1 and 2, the carousel ride 100 is composed of multiple, concentric, independently driven rings that can be moved at different speeds and/or in different directions. This allows the ride 100 to be operated for passing, racing, or near-miss experiences. The vehicles (such as vehicle 120) may be electrically actuated (or otherwise individually positionable) to follow show-programmed and/or vehicle rider-controlled/initiated motion as well as to be moved to their lowest position for load/unload. Each ring is supported on and guided by a circular track structure.

Figure 3:
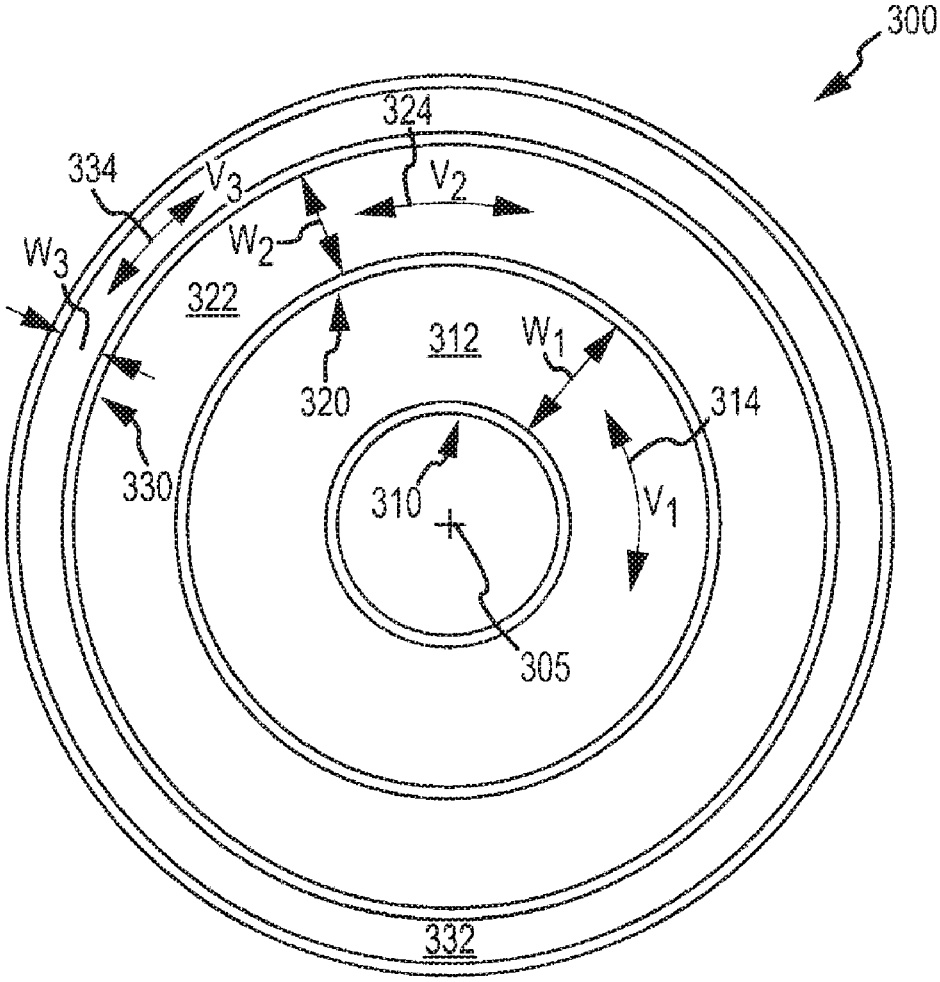
FIG. 3 illustrates schematically another embodiment of a carousel ride showing use of three rings to show that the upper (or load/unload) surface may be of differing width and to show that the ring upper surfaces may be moved independently from each other at the same rotation rate or different rates and/or in the same direction or different directions.

FIG. 3 illustrates schematically an embodiment of a ring carousel ride 300, which may implemented similarly to the ride 100 (e.g., with similar vehicles and drive/guide/positioning devices and so on). Ride 300 is shown to include three ring assemblies including an inner ring assembly 310, an intermediary or middle ring assembly 320, and an outer ring assembly 330. Each ring assembly is configured (as discussed with reference to ride 100 of FIGS. 1 and 2) to provide a rotating (or rotatable) ring-shaped surface 312, 322, 332 that rotates in a CW or CCW direction about a central axis 305 of the ride 300. The rotations or circular motions of the surfaces 312, 322, 332 are shown to be at one of the three velocities/rotation rates, $V_1$, $V_2$, or $V_3$, and in either a CW or CCW direction with arrows 314, 324, 334.

The ride 300 differs from ride 100 in that a fewer number of rings are included showing that ride embodiments may have two or more concentric rings. The ride 300, more significantly, differs from ride 100 in that the ring surfaces 312, 322, 332 each have differing widths. Specifically, the width, $W_1$, of the inner ring surface 312 is greater than the width, $W_2$, of the middle ring surface 322, which, in turn, is greater than the width, $W_3$, of the outer ring surface 332. This may be useful to provide vehicles of differing size and/or shape on different rings such as on ring assemblies 310 and 320. The use of a smaller width ring surface 332 as provided in ring assembly 330 may be useful for supporting non-vehicle elements such as obstacles and other game elements and/or ride environment/theming objects/elements.

Figure 4:
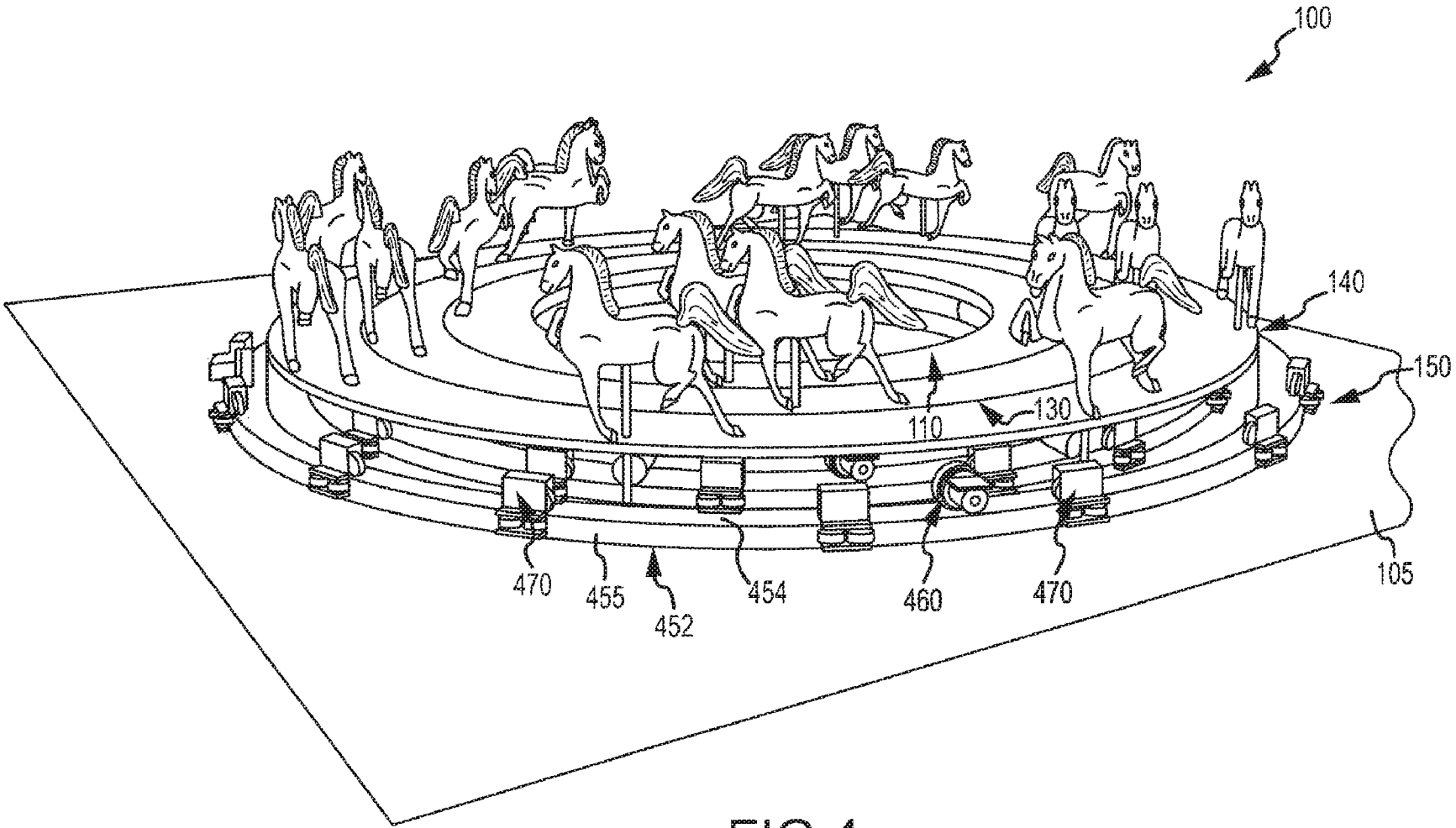
FIG. 4 illustrates a side perspective view of the carousel ride of FIGS. 1 and 2 with the body of the outer ring assembly (or, simply, the outer ring) removed to show ring guide assemblies used to maintain the outer ring on and aligned with its track structure and to show ring drive assemblies used to cause the outer ring to move on the track structure and rotate about the center axis of the ride (independently of other rings and at the same or differing speeds/directions)

Returning again to the ride 100, FIG. 4 illustrates the ride 100 with the outer ring of assembly 150 removed so as to illustrate the drive and guide components of ring assembly 150. As shown, the ring assembly 150 includes a track or track structure 452 with a top or upper surface 454 and a side surface 455 (here, the outer side surface but this is not required to practice the invention). The ring assembly 150 includes two or more (e.g., at least three may be preferred in some cases) ring drive assemblies or systems 460 spaced apart and attached to the ring (not shown) of assembly 150. Each of the drive systems 460 includes a wheel or roller that is pivotally supported in the system 460 and contacts the upper track surface 454 to support the ring (not shown). When the wheels are driven, the ring, which is attached to the drive systems 460, is caused to move on the circular path defined by the track 452 or its upper surface 454. To keep the drive assemblies 460 on the surface 454, the ring assembly 150 includes a plurality (e.g., two to five or more (as shown)) of guide assemblies 470. The guide assemblies 470 are affixed to the ring (not shown) of ring assembly 150 and also engage both the top surface 454 and the side surface 455 of track 452. Opposing guide assemblies 470, hence, retain the interconnected ring (not shown) in rolling (or sliding in some cases) engagement with track 452. Each of the other ring assemblies 110, 130, and 140 would be similarly driven and retained on their dedicated track structures.

As shown in FIG. 4, each ring is moved along a paired or associated track (e.g., a fixed track or guide) by at least three ring guide assemblies and at least one ring drive system. These assemblies may be mounted to the track or to the ring structure depending on configuration and/or other design requirements. Power and control may be hardwired (if track mounted) or provided through bus bars/slip rings (if ring mounted).

Figure 5:
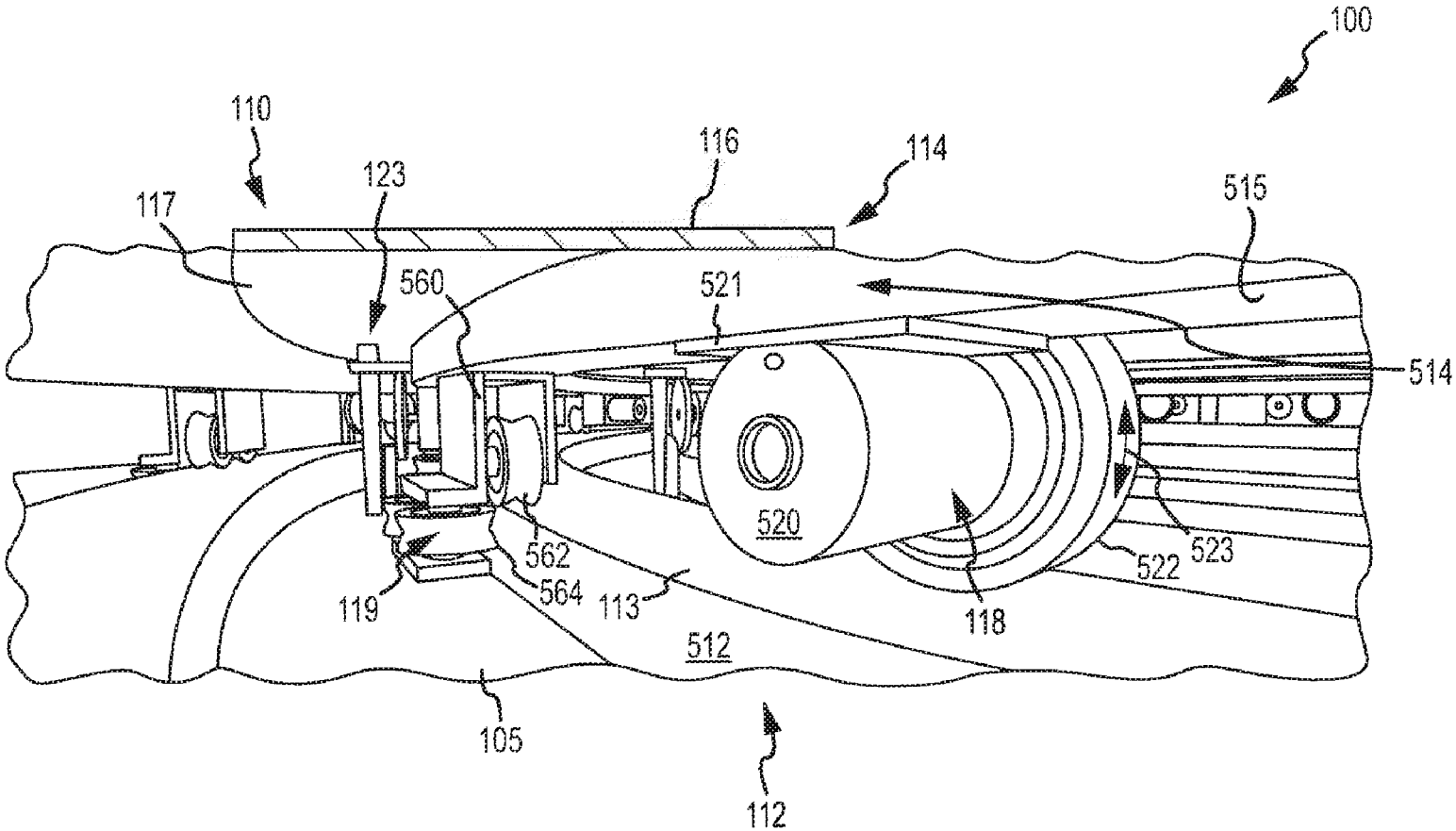
FIG. 5 provides a partial view of the ride of FIGS. 1 and 2 showing additional detail of a guide assembly and a drive assembly of the inner ring assembly (or first of four ring assemblies) of the ride.

FIG. 5 provides a detailed view of a portion of the ride 100. Particularly, a portion of the inner or first ring assembly 110 is shown from below or looking upward from the base or platform 105 toward the lower surface 117 of the ring 114. As shown, the ring 114 further includes a pedestal or ring base 514 extending downward from the lower surface 117 (e.g., a rigidly affixed or integral mounting and support structure that may be shaped similarly to the track 112 but a mirror image (e.g., facing downward whereas track 112 projects or faces upward, in this embodiment)).

The ring assembly 110 includes the drive system 118, the ring guide assembly 119, and the vehicle positioning mechanism 123. The drive system 118 may include a motor 520 that is mounted to a face or lower surface 515 of the ring base 514 via mounting plate 521. The drive system 118 also includes a traction wheel 522 that is selectively driven 523 (in either direction and at a range of velocities or RPM) to roll the supported ring 114 along a circular path on the upper support surface 113 of track 112. In some cases, the wheel 522 may ride in a groove on surface 113. In the illustrated embodiment of ride 100, though, the guide assembly 119 is used to retain the wheel 522 on the surface 113 of track 112.

To this end, the guide assembly 119 includes one, two, or more idling load wheels 562 riding on upper track surface 113 (to guide and provide normal/vertical load support for ring 114) and one, two, or more side guide wheels 564 abutting sidewall/surface 512 of track 112 that cause the ring 114 to rotate in a circle defined by the track 112 via sidewall 512. The wheels 562, 564 are supported for rotation (e.g., on axles or pins) in a frame 560, which, in this example, is rigidly affixed to the lower surface 515 of ring base 114. FIG. 5 also shows that the vehicle positioning/movement mechanism 123 is supported by the ring 114 such as via a mounting assembly extending through ring 114.

Figure 6:
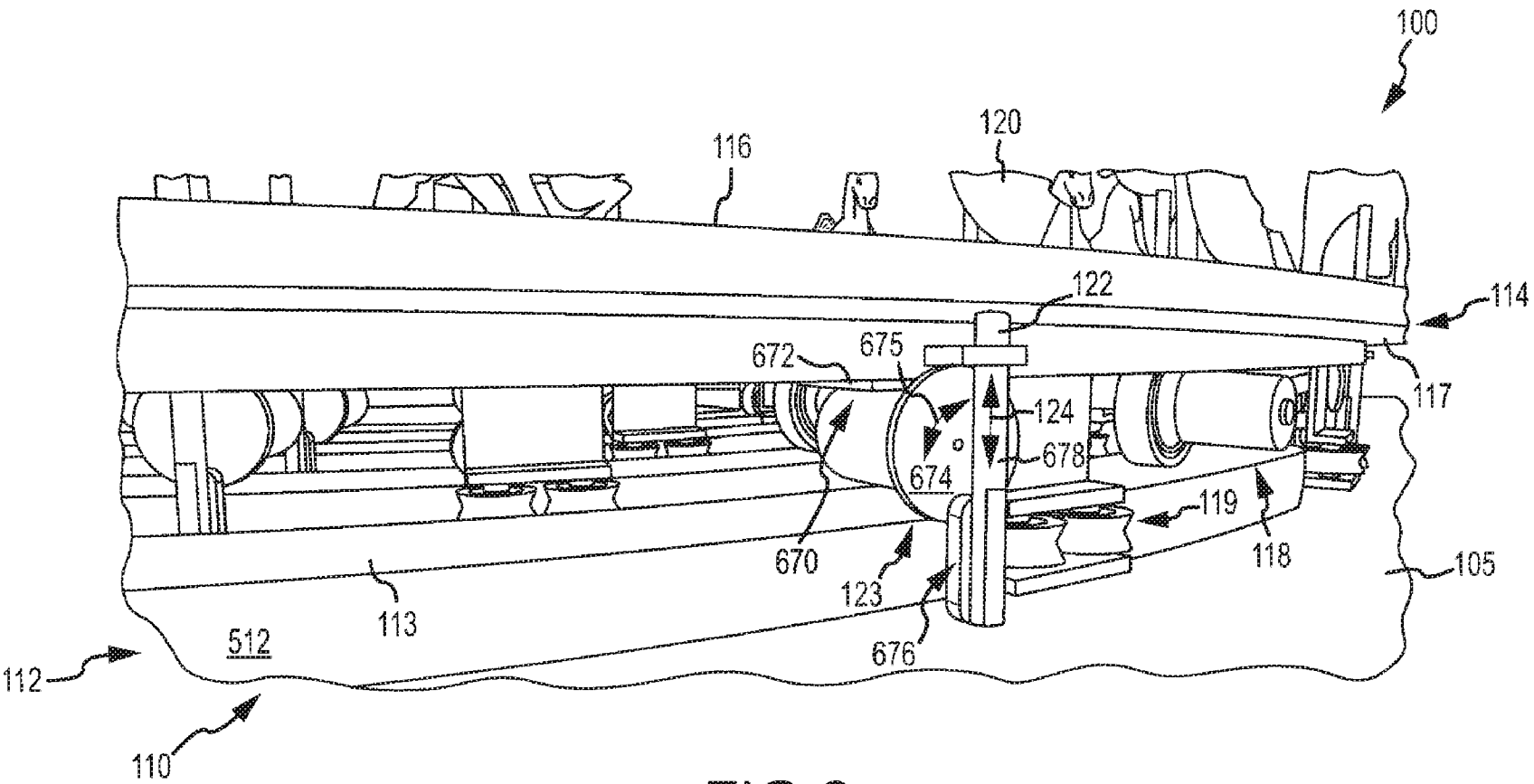
FIG. 6 is a partial view of the ride similar to FIG. 5 showing details of a vehicle positioning or movement mechanism providing individual, independent movement of each vehicle (that may be independent of the particular position of the platform/ring relative to the center axis in contrast to prior cam-based vehicle movement designs)
Figure 7:
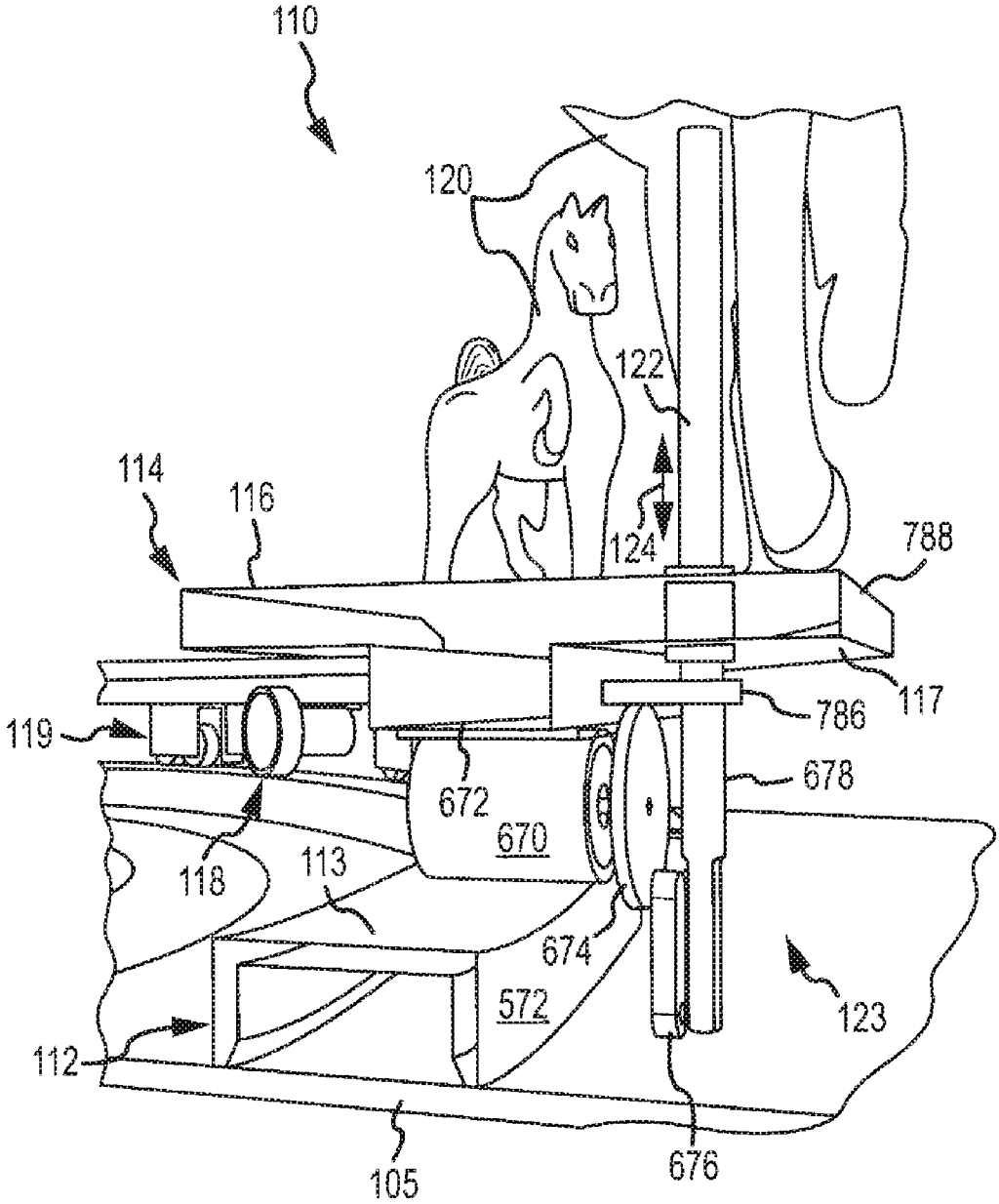
FIG. 7 is another partial view of the ride similar to FIGS. 5 and 6 showing the vehicle positioning mechanism in additional detail.

FIGS. 6 and 7 are partial views of ride 100 similar to FIG. 5 showing the drive 118 and guide 119 but also showing in detail one embodiment of a vehicle positioning (motion) mechanism 123. The vehicle positioning mechanism 123 may be configured to rotate the vehicle 120 or to at least move the vehicle 120 vertically up and down relative to the top (or load/unload) surface 116 of the ring 114. In FIG. 6, the embodiment of mechanism 123 is shown to provide up and down or vertical positioning. To this end, the mechanism 123 includes an actuator (e.g., a motor) 670 that is rigidly attached to the ring base 514 via mounting plate 672.

The actuator 670 is selectively operable (such as via control signals from a user input device associated with vehicle 120 and/or from a ride control system) to rotate 675 a drive wheel 674. A mechanical linkage 676 is provided to convert the rotation 675 of the wheel 674 to cause a lower or drive post 678 to move vertically up and down as shown with arrow 124, and the vehicle mounting post/pole 122 is connected to post 678 (or is simply an extension of post 678). Hence, pole 122 which may extend through ring 114 is actuated to move up and down through a motion profile while the ring 114 is rotated about the center axis of the ride 100.

FIG. 7 illustrates that a mounting element 788 may be used to facilitate mounting of the pole 122 (and interconnected vehicle 120) to ring 114. The mounting element 788 may include bearings or bearing surfaces facilitating sliding movement of the pole 122 through the ring 114 as drive post 678 is moved 124 up and down by actuator 670 of vehicle positioning mechanism 123. A stop 786 may be provided to limit travel of the pole 122 to a maximum vertical height, and another stop (not shown) may be used to limit lower travel to a load/unload position. FIG. 7 also shows mounting of ring drive 118 and guide assembly 119 to the ring 114 (or its base 514) to allow the ring 114 to be driven to move over track 112 (e.g., with drive or traction wheel of drive 118 abutting the track surface 113).

As can be seen, the ring carousel 100 includes a unique vehicle actuation system for the vehicles 120 of each ring 110, 130, 140, 150. Vehicles 120 are mounted to fixed positions around the rotatable rings 114 and are also each connected to a vehicle actuation system or mechanism 123. The vehicle actuation system 123 is configured and/or designed to be able to move the vehicle 120 through a vertical range of motion. Each system 123 is connected to a vehicle 120 through a mounting element 778 and mechanical linkage 676, 678, 786 that limits the range and defines the direction of vehicle motion 124. Power and control may be provided to the actuator/motor 670 through bus bars or slip rings. Control/input devices associated with the vehicle 120 may be operated to, at least in part, control operation of the actuator/motor 670.

Providing a vehicle positioning mechanism or system 123 for each vehicle provides a number of advantages when compared to traditional carousels. The mechanism 123 allows use of programmable motion profiles to control the actuator 670 and define vertical motion 124. For example, the motion profiles may be relatively standard oscillations or more complex and/or interesting motion waveforms that may extend beyond one, two, or more rotations of the ring about the ride's center axis. Further, use of mechanism 123 allows rider controlled motion and/or interactive response to gaming by the vehicle's rider or to rider input. Still further, use of mechanisms 123 allows the ride 100 to be designed to return all of the vehicles 120 to a load/unload position, e.g., move the vehicles 120 to a consistent, predictable, and safe load/unload position at the vehicle's lowest height relative to the top surface 116 (or another convenient loading position) of ring 114 to facilitate rider/passenger entry and exit from the ride 100.

Figure 8:
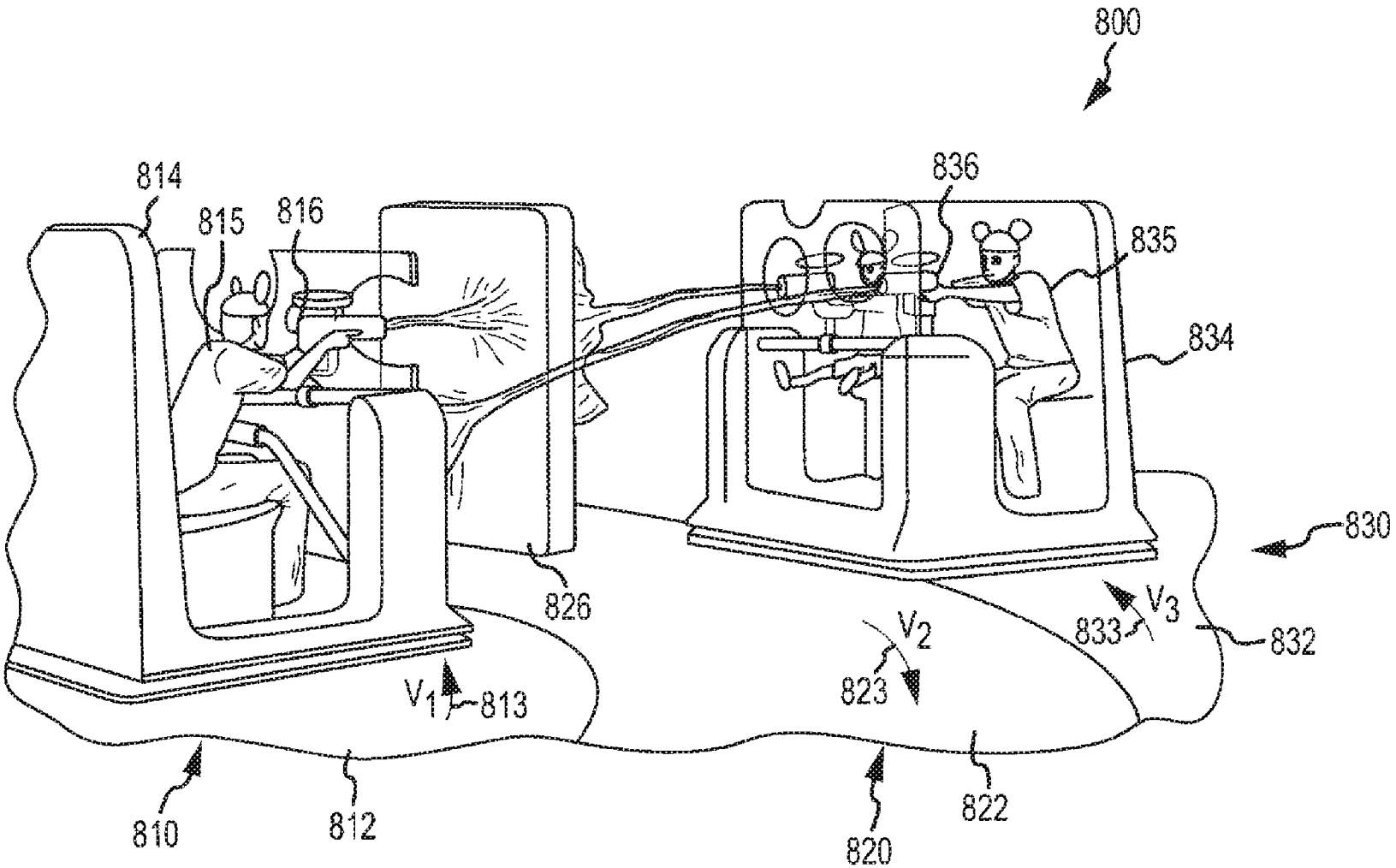
FIG. 8 is a partial illustration of another embodiment of a ring carousel ride of the present description showing use of an intermediary ring assembly to provide game/environment elements adjacent to vehicle rings and, in this case, to rotate in an opposite direction (e.g., CW while the vehicles rotate on their rings in a CCW direction)

The use of two or more concentric rings that are independently driven and that may be used to support individually actuated vehicles opens up a large number of new ride design opportunities. FIG. 8 illustrates one embodiment of a ring carousel ride 800 achievable due to the use of independently-driven, concentric rings. The ride 800 is adapted for riders to be able to interact with other riders and/or game elements, and the riders and game elements may be varied throughout the ride's operation such as by moving some of the rings at differing speeds and/or in differing directions.

To this end, ride 800 includes three ring assemblies shown as inner or first ring assembly 810, middle/intermediate or second ring assembly 820, and outer or third ring assembly 830. The first and third ring assemblies 810, 830 are shown to include rings 812, 832 that are rotated in the same direction as shown with arrows 813, 833 (but, in the ride 800 these may also be opposite directions) at velocities, $V_1$ and $V_3$. The ride 800 includes vehicles 814 and 834 with seating for riders 815, 835, and the vehicles 814, 834 are supported upon rings 812, 832 to rotate 813, 833 with the rings 812, 832.

The velocities, $V_1$ and $V_3$, of the rings 812, 832 may be substantially equal such that the riders 815, 835 are adjacent each other throughout the ride to allow ongoing competition or interaction. Such interaction may include operation of user input/game devices 816, 836 associated with vehicles 814, 834, e.g., squirt guns, laser devices, and so on. In other cases, though, the velocities, $V_1$ and $V_3$, differ for at least portions of the operation of the ride 800 such that the orientation of the vehicles 814, 834 relative to each other varies and/or such that other vehicles (not shown) are positioned proximate or adjacent to vehicles 814, 834 to allow the riders 815, 835 to interact/compete with different riders during a single operation of the ride 800. Differing the velocities, $V_1$ and $V_3$, is readily achievable as explained above through control of the ring drives associated with the concentric and independently driven rings 812, 832.

While rings 812, 832 are used to move vehicles 814, 834 through the ride 800, the ride 800 also includes a non-vehicle ring assembly 820. The assembly 820 includes a ring 822 that is rotated 823 in a direction opposite of the vehicle rings 812, 832 (but, in some embodiments, this may be the same direction for at least part of the ride operation). The non-vehicle ring 822 is used to support a show, game, or ride element 826 (e.g., a targeting obstacle or shield). By having the ring 822 rotating 823 in an opposite direction, the riders 815, 835 have to time operation of their game devices 816, 836 so as to avoid the obstacle 826 so as to strike the other vehicle 814, 834 or its riders 815, 835. In other cases, the element 826 may simply be a ride environmental or theme component enhancing enjoyment of the ride 800 and/or may be a target element for a game played on the ride 800 (e.g., the riders 815, 835 may be encouraged to aim the devices 816, 836 at the element 826 and carefully time operation of the devices 816, 836 for fun and/or to increase their game score). Since the non-vehicle or obstacle ring assembly 820 is separately driven, the ring 822 may be used to position the obstacle 826 between or relative to one or both of the vehicles 814, 834 in any desired manner (e.g., in an unpredictable manner).

Figure 9:
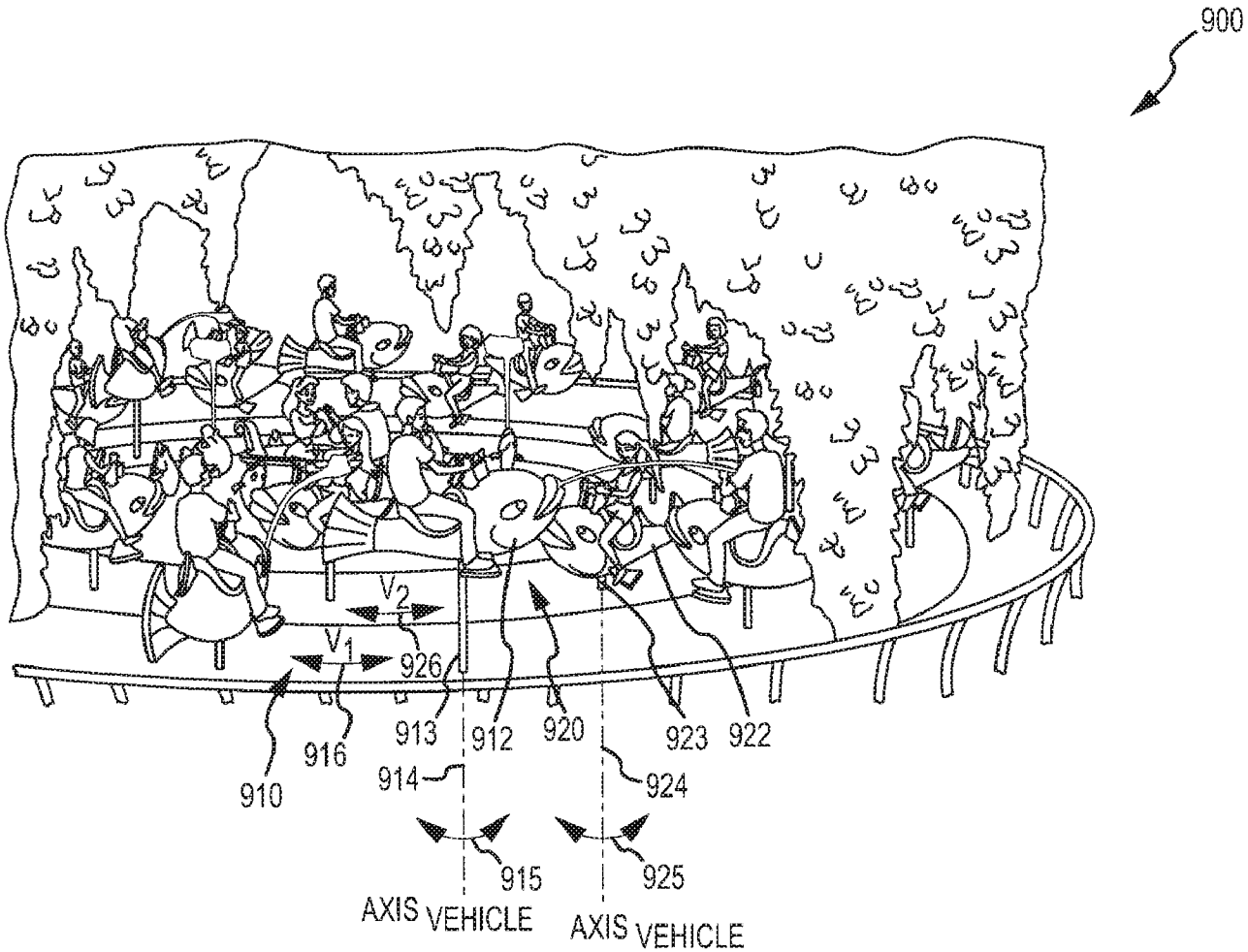
FIG. 9 illustrate another ring carousel ride further illustrating concepts of the invention showing rider control over the height and angular orientation of their vehicle during ring rotation.

FIG. 9 illustrates another embodiment of a concentric ring carousel ride 900. An outer ring assembly 910 and an inner ring assembly 920 are provided in the ride 900. Each may be configured as discussed above to have rings that are concentric and are independently driven in the same or different directions and at the same or different velocities as shown with arrows 916, 926. Each ring assembly 910, 920 includes one or more vehicles 912, 922 that are supported so as to move 916, 926 along a circular path with the rings of the assemblies 910, 920. Each vehicle 912, 922 is supported on a pole 913, 923 and are separately positioned or moved up and down. Further, though, each vehicle 912, 922 may be rotated 915, 925 about the axis of the pole 913, 923 in one or both directions. Such movement may be controlled by a ride control system (such as through operation of a vehicle positioning mechanism (not shown in FIG. 9)) and/or may be responsive to rider input on a device associated with the vehicles 912, 922. This allows the riders to change their angular orientation during rotation of the rings of assemblies 910, 920 such as to change their view, to increase the thrill of the ride 900 by adding a spin feature, and/or to interact with numerous riders of other vehicles (e.g., to participate in an ongoing game).

Figure 10:
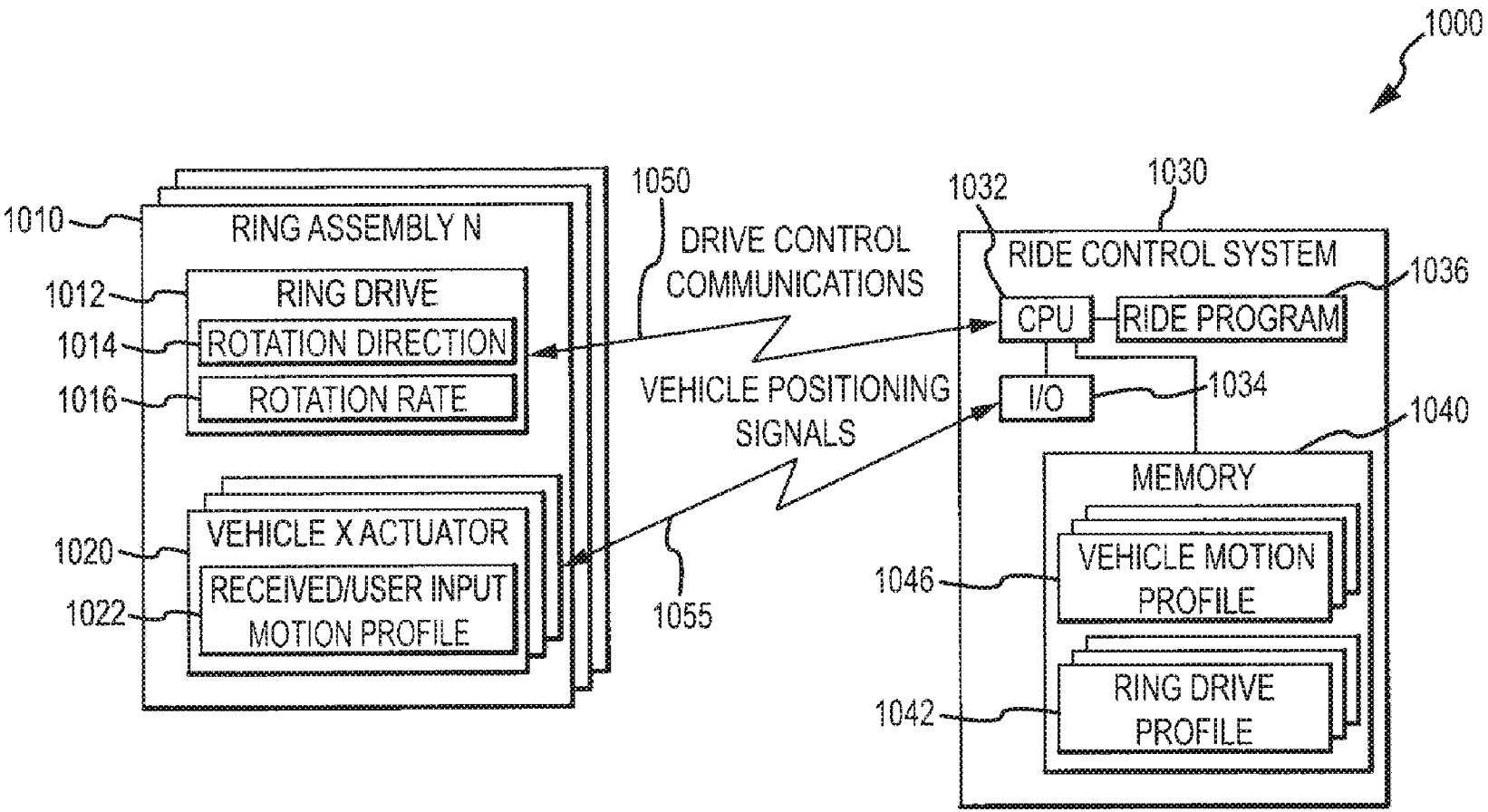
FIG. 10 is a block diagram showing a carousel ride including a ride control system or controller to control operation of the ring drives and the vehicle actuators.

FIG. 10 illustrates in block diagram form an embodiment of a ride 1000 that may be used to implement aspects of the present invention. For example, the control and communication features of ride 1000 may be used with ride 100 of FIG. 1. As shown, the ride 1000 may include two or more ring assemblies 1010 used to provide independently driven, concentric, rotating ring surfaces upon which vehicles are supported to rotate with the ring surfaces about a center or rotation axis. Each ring assembly 1010 includes one or more ring drives 1012 that are operable such that the ring surface is rotated in one of two rotation directions 1014 (e.g., CW or CCW) and at one or more rotation rates 1016 (e.g., over a range of RPM defined by a motion profile and/or control signals 1050, or the like). Further, each ring assembly 1010 includes a number of vehicle actuators 1020 that are each associated with a vehicle on the ring of assembly 1010, and each actuator 1020 is operable to operate per a received motion profile (or control signals 1055) such as to move a vehicle up and down through a number of heights relative to a ring surface. Each of the actuators 1020 may be operated separately in the same or in differing ways (e.g., the same to place the vehicles in load/unload positions, differently to create a desired ride experience, and so on).

The ride 1000 also includes a ride control system or ride controller 1030. The control system 1030 functions to transmit control signals to the ring drive to control operation of the ring drive 1012 of each ring assembly, and these signals may be selected in part by position and other ride data provided by the ring assembly to the ride control system 1030. Both such signals are shown as drive control communications 1050 that may be transmitted in a wired or wireless manner. Also, the control system 1030 functions to transmit control signals to vehicle actuators 1020 (which may be stored as shown at 1022 or otherwise buffered for use by actuator 1020), and the control system 1030 may select such positioning signals/motion profiles 1022 based on feedback or ride data received from ring assembly 1010. These communications are shown as vehicle positioning signals 1055 and, again, these may be wired or wireless communications.

The ride control system 1030 includes one or more hardware processors (or central processing units (CPUs)) 1032 that execute or run software, programming, and/or code devices (e.g., code on computer readable medium that cause a computer/control system to perform particular functions). For example, the CPU 1032 may execute a ride program 1036 to provide the ride control functions described herein. These functions may include accessing memory 1040 managed by or accessible by CPU 1032 to select and retrieve a vehicle motion profile from a plurality of such profiles defining motion of each vehicle of a ring assembly 1010. The CPU 1030 may then operate one or more input/output devices to transmit the chosen profile 1046 as vehicle positioning signals 1055 to direct operation of a vehicle actuator 1020 based on the motion profile 1022. The motion profile 1022 may define an up and down movement from a load/unload position through a range of heights and/or may cause the vehicle to be rotated or otherwise moved (e.g., vibrated). The ride program 1036 may also cause the CPU 1032 to access memory 1040 to select and retrieve a ring drive profile from one or more profiles 1042. Then, the CPU 1032 may operate an I/O device 1034 to transmit the drive control signals 1050 to the ring drive 1012 to rotate the ring in a particular direction 1014 and at a particular velocity (or range of velocities) 1016.

Although the invention has been described and illustrated with a certain degree of particularity, it is understood that the present disclosure has been made only by way of example, and that numerous changes in the combination and arrangement of parts can be performed by those skilled in the art without departing from the spirit and scope of the invention, as hereinafter claimed. For example, the illustrated embodiments shows each of the top or upper surfaces (rotating surfaces) of the rings to be substantially coplanar (i.e., within several inches of each other). However, in some embodiments, the rings may be configured to provide tiered rotating surfaces that are still independently driven but that are not coplanar.

Also, the illustrated rides showed rings supporting vehicles from below or underneath. The description is not limited to such an arrangement as the concepts described herein are also well suited to use with vehicles supported from above (hanging vehicles) and rings provided above the vehicles. In such as arrangement, the guide assemblies likely would be configured to provide vertical support (support for normal loading) of the vehicles rather than the drive assemblies as in the illustrated examples. Still further, the guide assembly and the drive assembly may be combined into a single assembly or system, with the particular implementation of the drive assembly and guide assembly not being limiting of the invention.

The ring carousel ride described provides a number of advantages over previous carousels that are due to the described differences and unique aspects. The rings may be driven at differing and varying rotation rates about the center axis (e.g., an inner ring may start at a slower rate at the initial stages of a ride and then speed up to be faster than an adjacent middle/interior ring and so on) to deliver realistic racing experiences that are not possible with conventional carousels. Vehicles such as horses can change position by a full length or more for more realistic racing effects. Additionally, the ride system may be programmed such that the vehicles to the left and right of each vehicle change throughout the ride for enhanced interaction between riders of the vehicles (e.g., passing by different people), playing a game involving different riders (e.g., squirting water at differing riders, targeting different vehicles in an interactive ride/video game, and so on), and the like. The carousels described herein provide opportunities for new types of guest experiences with a relatively simple ride system and, significantly, within a small footprint (e.g., the same or a similar footprint as a conventional carousel ride). No overhead canopy is required, a central rotating structure or hub is not required, and a pole extending above the vehicles is not required.

With the addition of individually actuated vehicle positioning elements (e.g., electrically actuated devices linked to a mounting post/pole), riders can safely board vehicle at a lowered "home" position to which the vehicles are returned at the end of a ride. Vehicles can move in customizable and unpredictable (to the riders) ways. Horses/vehicles on adjacent rings can "race" as the relative rotation rate between the rings is changed during the operation of the ride (such as by the ride controller providing differing control signals to ring drive assemblies based on execution of a ride program/software and/or input from a human ride operator). Vehicle motion may be programmed to follow interesting show profiles and/or controlled (at least in part) by each vehicle's rider/passenger.

Thrill/excitement at different radii (or in different rings) may be balanced such as by causing the inner rings to run faster than outer rings (e.g., the rate of rotation of the rings is progressively faster from outer to inner ring or vice versa). Alternatively, the rotation rate may differ among the rings in some unpredictable manner (e.g., randomly selected at the beginning or during the operation of the ride from two or more rotation rates). Likewise, the direction of the rotation may vary among the rings and may be changed during the ride to achieve desired game or ride experiences.

The ring carousel rides allow for new and interesting guest interactions since the rides have the capability of moving many vehicles past each other. This provides opportunities for interactive and gaming activities (target different vehicles with a vehicle mounted "gun" such as a water gun to drench different riders or laser gun to obtain game points) in configurations that do not resemble traditional carousels. New gaming opportunities and unpredictable motion make the ring carousel ride a unique experience that will encourage riders to repeat the ride more often (e.g., not just once as is common with traditional carousels). The same carousel ride may be configured and programmed to provide differing experiences such as by adding story elements where things go "wrong" or magically transform the experience such that riders do not get the expected ride even though they entered a ride that had some of the appearances of a traditional carousel (e.g., their vehicle may suddenly slow down or stop and even change direction while other vehicles on different rings continue in the other direction).

We claim:

1. A carousel ride, comprising:

an inner ring assembly comprising a first ring supporting a number of rider conveyance elements and a drive system operable to rotate the first ring about a center axis of the carousel ride; and an outer ring assembly comprising a second ring, concentric to the first ring, supporting a number of rider conveyance elements and a drive system operable to rotate the second ring about a center axis of the carousel ride, wherein the inner ring assembly further comprises a vehicle positioning mechanism associated with each of the rider conveyance elements, each of the vehicle positioning mechanisms being independently operable to move the associated rider conveyance element through a range of heights according to a motion profile, the motion profile defining the range of heights over more than one full rotation of the inner ring about the center axis.

2. The carousel ride of claim 1, wherein, during a portion of a ride operation of the carousel ride, the drive system of the inner ring assembly operates to rotate the first ring at a first rotation rate and the drive system of the outer ring assembly operates to rotate the second ring at a second rotation rate differing from the first rotation rate.

3. The carousel ride of claim 1, wherein, during a portion of a ride operation of the carousel ride, the drive system of the inner ring assembly operates to rotate the first ring in a clockwise direction about the center axis and the drive system of the outer ring assembly operates to rotate the second ring in a counterclockwise direction.

4. The carousel ride of claim 1, wherein the inner ring assembly further includes a first ring-shaped track adjacent the first ring and a plurality of guide assemblies retaining the drive system of the inner ring assembly in contact with the first ring-shaped track and wherein the outer ring assembly further includes a second ring-shaped track adjacent the second ring and a plurality of guide assemblies retaining the drive system of the outer ring assembly in contact with the ring-shaped track.

5. The carousel ride of claim 1, wherein the first ring includes a planar top surface and the rider conveyance elements are supported above the top surface of the first ring and wherein the second ring includes a planar top surface and the rider conveyance elements are supported above the top surface of the second ring, and further wherein the top surfaces of the first and second rings are substantially coplanar.

6. The carousel ride of claim 1, wherein the vehicle positioning mechanisms operate concurrently at an end of a ride operation of the carousel ride to position all of the rider conveyance elements in a load/unload position.

7. A ride apparatus, comprising:

first, second, and third vehicle supports, wherein each of the vehicle supports includes a body with a planar upper surface and wherein the planar upper surfaces are ring-shaped and concentric to each other relative to a shared rotation axis;

a plurality of vehicles supported on the vehicle supports above the planar upper surfaces;

first, second, and third circular tracks adjacent to the first, second, and third vehicle supports, respectively;

first, second, and third sets of drives independently driving the first, second, and third vehicle supports to rotate the first, second, and third vehicle supports about the rotation axis upon the first, second, and third circular tracks, respectively; and a vehicle positioning assembly for each of the vehicles, wherein the vehicle positioning assemblies are independently actuated to move each of the vehicles through a range of vertical positions relative to the planar upper surfaces, and wherein the vehicle positioning assemblies operate to move all the vehicles to an unload/load position when the drives end rotation of the vehicle supports.

8. The apparatus of claim 7, wherein the first, second, and third sets of the drives are selectively operated by a ride control system to rotate the vehicle supports at first, second, and third rotation rates, respectively, and wherein at least one of the rotation rates differs from other ones of the rotation rates.

9. The apparatus of claim 8, wherein the first, second, and third sets of drives are each operable to rotate the first, second, and third vehicles supports in the clockwise and the counterclockwise direction about the rotation axis.

10. The apparatus of claim 7, wherein the second vehicle support, is positioned between the first and third vehicle supports and wherein a plurality of ride elements are positions upon the upper surface of the second vehicle support.

11. The apparatus of claim 7, wherein the planar upper surfaces are substantially coplanar and wherein at least one of the sets of drives is operated to rotate the corresponding vehicle support at two or more rotation rates as defined by a ride profile.

12. The apparatus of claim 7, further comprising first, second, and third sets of guides retaining an aligned relationship between the first, second, and third tracks and the first, second, and third sets of drives, whereby drive wheels of each of the drives contacts one of the planar upper surfaces.

13. A ride, comprising:

a plurality of concentric, ring-shaped supports;

on at least two of the supports, a plurality of passenger vehicles each supported on a pole extending from a corresponding one of the supports; and for each of the passenger vehicles, a vehicle positioning actuator independently operating in response to control signals to move the corresponding passenger vehicle through a range of positions via movement of the pole, wherein the passenger vehicles each include a user input device and wherein each of the vehicle positioning actuators are operable based on operation of a corresponding one of the user input devices to position the passenger vehicle relative to the ring-shaped support.

14. The ride of claim 13, wherein the ring-shaped supports are each supported by a circular track, the ride further including for each of the ring-shaped supports two or more drive systems rigidly connected to the ring-shaped support and abutting the circular track, and wherein the drive systems of each ring-shaped support are independently operable to independently rotate the ring-shaped supports about a rotation axis.

15. The ride of claim 14, wherein the ring-shaped supports are rotated at differing rotation rates during at least a portion of the operation of the ride.

16. The ride of claim 14, wherein at least one of the ring-shaped supports is rotated in a differing direction about the rotation axis during at least a portion of the operation of the ride.

17. The ride of claim 13, wherein the ring-shaped supports each comprise an exposed load/unload surface and wherein the load/unload surfaces are substantially coplanar.

* * * * *